US006194686B1

(12) United States Patent
Gohl

(10) Patent No.: US 6,194,686 B1
(45) Date of Patent: Feb. 27, 2001

(54) PORTABLE GROUND THAWING PANEL SYSTEM

(76) Inventor: Russell R. Gohl, 1725 5th St. SE., Minot, ND (US) 58701

( * ) Notice: Subject to any disclaimer, the term of this patent is extended or adjusted under 35 U.S.C. 154(b) by 0 days.

(21) Appl. No.: 09/532,417

(22) Filed: Mar. 22, 2000

(51) Int. Cl.[7] ..... H05B 1/00
(52) U.S. Cl. ..... 219/213; 219/520; 126/271.1
(58) Field of Search ..... 219/200, 209, 219/212, 213, 520, 531, 532, 536, 537, 217, 528; 126/271.1, 271.2 R, 91 A

(56) References Cited

U.S. PATENT DOCUMENTS

| | | | | |
|---|---|---|---|---|
| 3,132,642 | | 5/1964 | Fingland . | |
| 3,303,324 | * | 2/1967 | Appleman | 219/213 |
| 3,479,490 | * | 11/1969 | Stark | 219/213 |
| 3,868,825 | | 3/1975 | Boyce . | |
| 3,936,661 | * | 2/1976 | Furuishi et al. | 219/528 |
| 3,961,157 | * | 6/1976 | Miller et al. | 219/213 |
| 5,033,452 | | 7/1991 | Carriere . | |
| 5,371,340 | * | 12/1994 | Stanfield | 219/217 |
| 5,387,778 | * | 2/1995 | Stanger | 219/213 |
| 5,441,038 | | 8/1995 | Ohmann . | |
| 5,820,301 | | 10/1998 | Bruckelmyer . | |
| 5,964,402 | | 10/1999 | Jakobson . | |

* cited by examiner

*Primary Examiner*—Tu Ba Hoang

(57) ABSTRACT

A portable ground thawing panel system for thawing an area of frozen ground to allow digging in the wintertime. The inventive device includes an upper member, a plurality of outer member secured to the upper member, a layer of insulation adjacent the upper member, a divider member adjacent the insulation opposite the upper member, and an electrical heating element secured to the divider member opposite of the insulation. The heating element may be temperature self-regulating or a thermostat may be electrically connected to the heating element.

2 Claims, 3 Drawing Sheets

PORTABLE GROUND THAWING PANEL SYSTEM

BACKGROUND OF THE INVENTION

1. Field of the Invention

The present invention relates generally to ground thawing devices and more specifically it relates to a portable ground thawing panel system for thawing an area of frozen ground to allow digging in the wintertime.

2. Description of the Prior Art

Ground heating devices have been in use for years. Typically, a heating devices utilized to thaw frozen ground circulate a heated fluid such as water or air to transfer heat to the frozen ground thereby thawing the frozen ground to allow digging and other ground work to occur.

Conventional ground heating devices require a significant heat source to the heat the fluid along with pumps to circulate the heated fluid about tubing or other structure. Conventional ground heating devices are complicated. to utilize and are difficult to repair when damaged.

Examples of patented heating devices include U.S. Pat. No. 5,820,301 to Bruckelmyer; U.S. Pat. No. 5,441,038 to Ohmann; U.S. Pat. No. 3,868,825 to Boyce; U.S. Pat. No. 5,033,452 to Carriere; U.S. Pat. No. 5,964,402 to Jakobson; U.S. Pat. No. 3,132,642 to Fingland which are all illustrative of such prior art.

While these devices may be suitable for the particular purpose to which they address, they are not as suitable for thawing an area of frozen ground to allow digging in the wintertime. Conventional ground thawing devices are bulky and difficult to utilize.

In these respects, the portable ground thawing panel system according to the present invention substantially departs from the conventional concepts and designs of the prior art, and in so doing provides an apparatus primarily developed for the purpose of thawing an area of frozen ground to allow digging in the wintertime.

SUMMARY OF THE INVENTION

In view of the foregoing disadvantages inherent in the known types of thawing devices now present in the prior art, the present invention provides a new portable ground thawing panel system construction wherein the same can be utilized for thawing an area of frozen ground to allow digging in the wintertime.

The general purpose of the present invention, which will be described subsequently in greater detail, is to provide a new portable ground thawing panel system that has many of the advantages of the ground thawing devices mentioned heretofore and many novel features that result in a new portable ground thawing panel system which is not anticipated, rendered obvious, suggested, or even implied by any of the prior art thawing devices, either alone or in any combination thereof.

To attain this, the present invention generally comprises an upper member, a plurality of outer member secured to the upper member, a layer of insulation adjacent the upper member, a divider member adjacent the insulation opposite the upper member, and an electrical heating element secured to the divider member opposite of the insulation. The heating element may be temperature self-regulating or a thermostat may be electrically connected to the heating element.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a portable ground thawing panel system that will overcome the shortcomings of the prior art devices.

A second object is to provide a portable ground thawing panel system for thawing an area of frozen ground to allow digging in the wintertime.

Another object is to provide a portable ground thawing panel system that efficiently thaws frozen ground.

An additional object is to provide a portable ground thawing panel system that is easy and simple to utilize.

A further object is to provide a portable ground thawing panel system that does not require a fuel source such as propane or a circulating pump.

Another object is to provide a portable ground thawing panel system that is portable.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
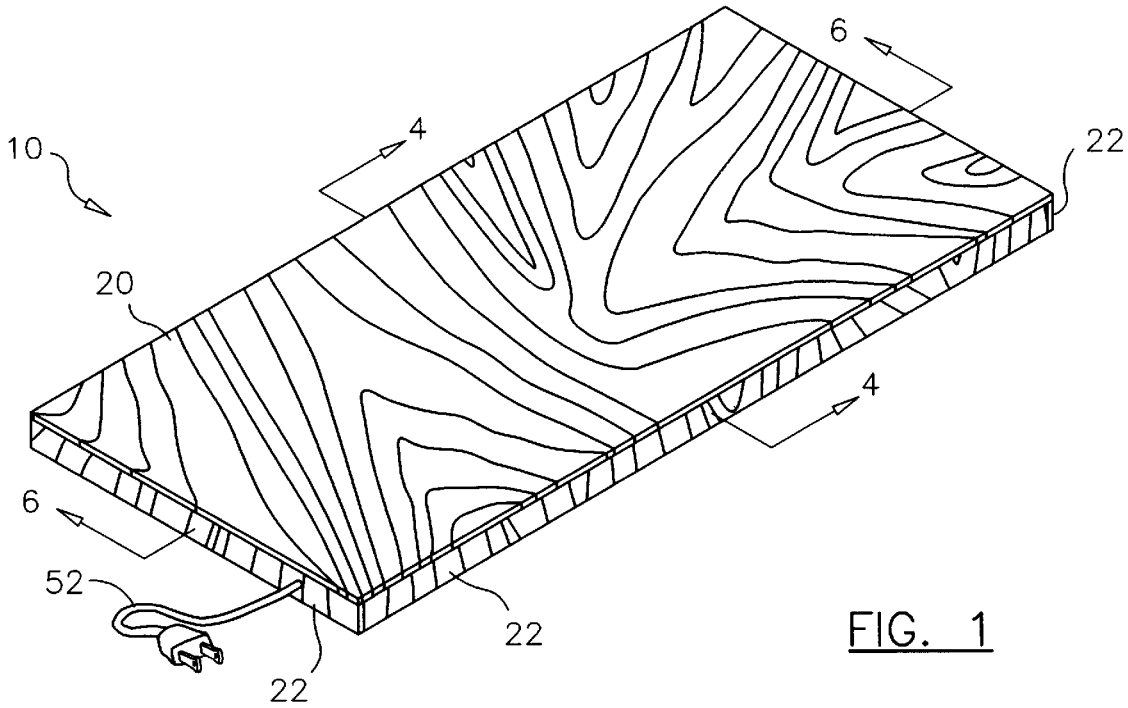
FIG. 1 is an upper perspective view of the present invention.

Turning now descriptively to the drawings, in which similar reference characters denote similar elements throughout the several views, FIGS. 1 through 6 illustrate a portable ground thawing panel system 10, which comprises an upper member 20, a plurality of outer member secured to the upper member 20, a layer of insulation 30 adjacent the upper member 20, a divider member 40 adjacent the insulation 30 opposite the upper member 20, and an electrical heating element 50 secured to the divider member 40 opposite of the insulation 30. The heating element 50 may be temperature self-regulating or a thermostat may be electrically connected to the heating element 50.

Figure 2:
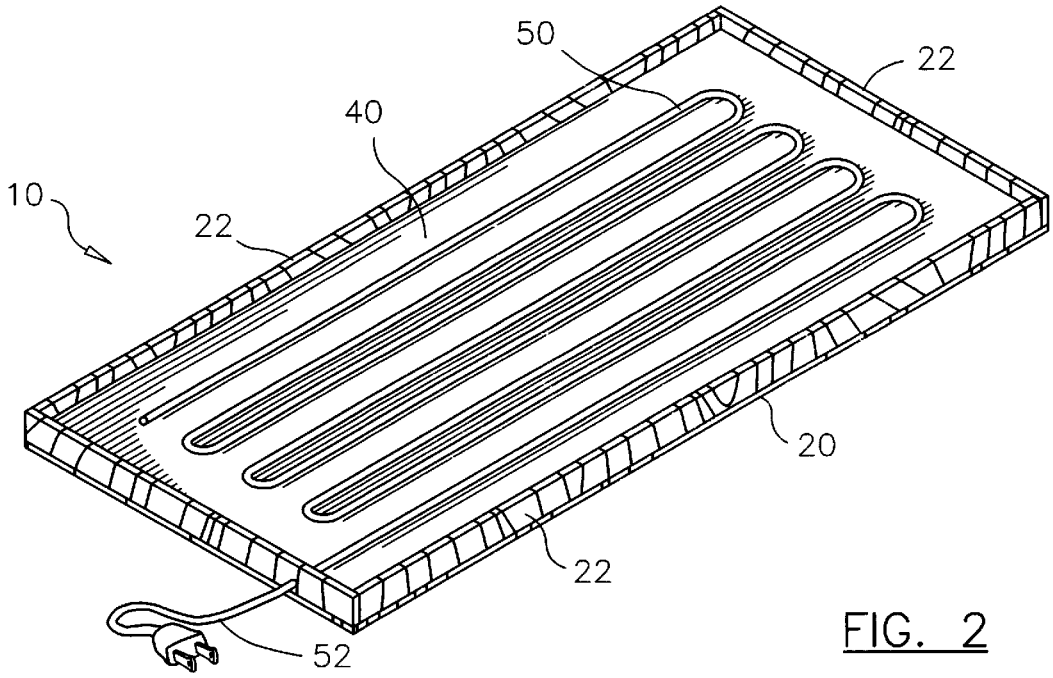
FIG. 2 is an upper perspective view of the present invention inverted showing the heating element.
Figure 3:
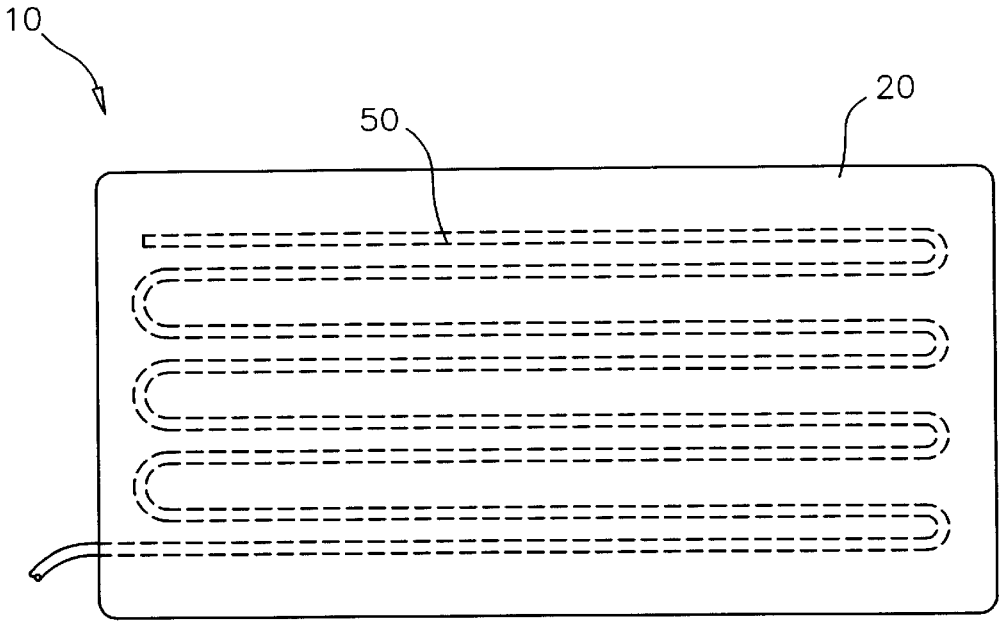
FIG. 3 is a top view of the present invention.
Figure 4:
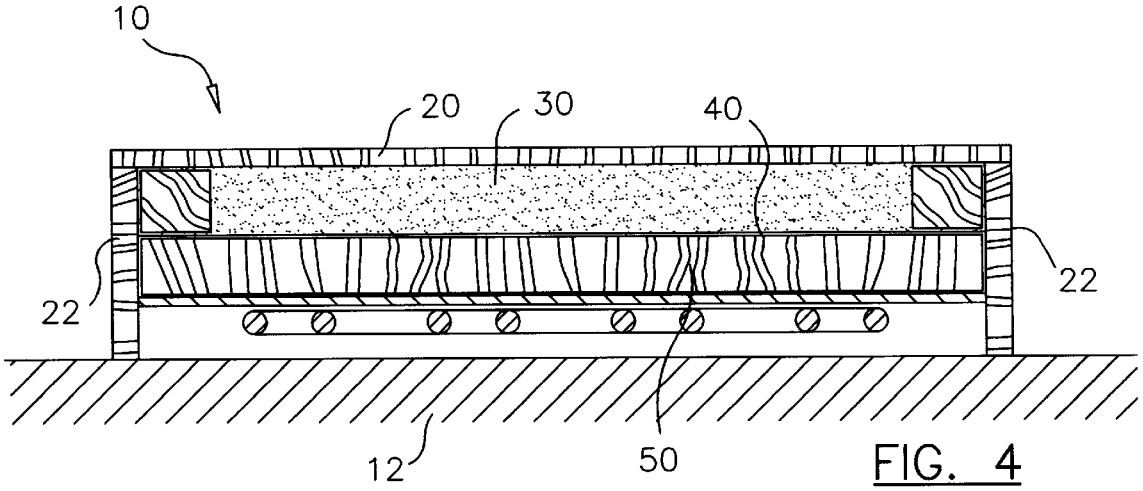
FIG. 4 is a cross sectional view taken along line 4–4 of FIG. 1.
Figure 5:
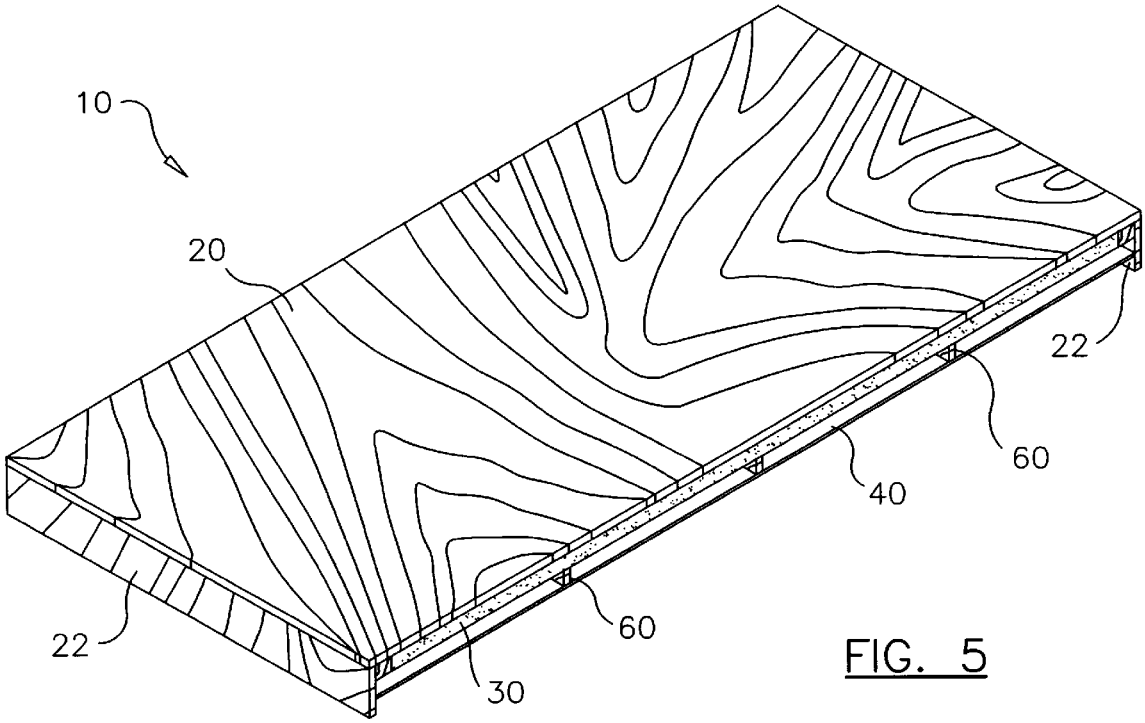
FIG. 5 is an upper perspective cutaway view of the present invention.

As shown in FIGS. 1, 3, and 5 of the drawings, an upper member 20 is provided that has an upper surface and a lower surface. A plurality of outer members 22 are attached to the outer portions of the upper member 20. The upper member 20 is a flat structure having various shapes and sizes. The upper member 20 may be comprised of any well-known material such as wood or metal. The outer members 22 preferably extend orthogonally downwardly from the outer perimeter of the upper member 20 as best shown in FIGS. 2, 4 and 6.

Figure 6:
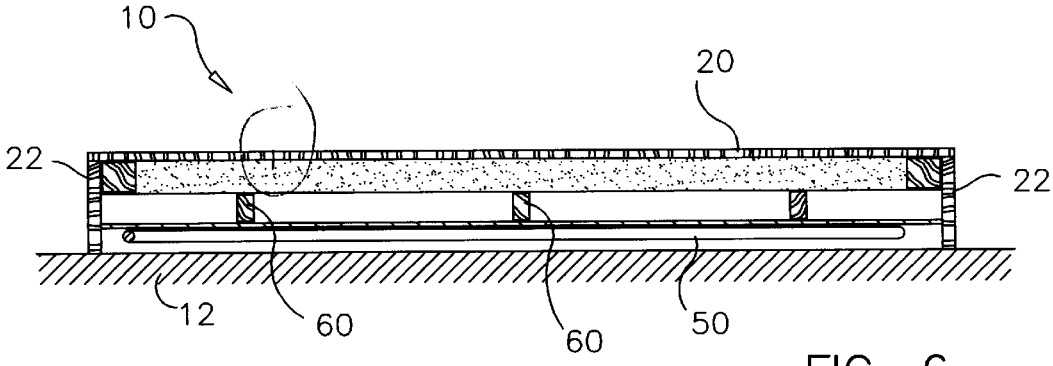
FIG. 6 is a cross sectional view taken along line 6–6 of FIG. 1.

As shown in FIGS. 4 through 6 of the drawings, at least one layer of insulation 30 is positioned adjacent the lower surface of the upper member 20. The insulation 30 may be comprised of any known insulating material such as a foam-structure or other known material.

As shown in FIGS. 4 through 6 of the drawings, a plurality of cross members 60 extend between opposing outer members 22 thereby supporting the insulation 30 adjacent the lower surface of the upper member 20. The plurality of cross members 60 also provide support and stability to the portable ground thawing panel system 10.

As shown in FIGS. 2, 4, 5 and 6 of the drawings, a divider member 40 is attached between the outer members 22 and to the lower portions of the cross members 60. The divider member 40 is preferably constructed of a non-flammable material such as metal. As best shown in FIG. 2 of the drawings, the divider member 40 is positioned inwardly from the lower edge of the outer members 22 creating a lower cavity that retains and dispenses the heat from the heating element 50.

As shown in FIGS. 2, 3, 4 and 6 of the drawings, a heating element 50 is secured to the divider member 40 opposite of the cross members 60. The heating element 50 is a well-known electrical heating device that utilizes resistance from the flow of electricity to create heat. The heating element 50 may have any configuration with one configuration shown in FIGS. 2 and 3 of the drawings. The heating element 50 preferably extends about a substantial portion of the divider member 40 as shown in FIGS. 2 and 3 of the drawings. A power cord 52 is electrically connected to the heating element 50 for allowing the user to provide electrical power to the heating element 50. The heating element 50 may be temperature self-regulating or a control switch may be electrically connected within for allowing control of the temperature of the heating element 50.

In use, the user positions the portable ground thawing panel system 10 upon the surface of the area of frozen ground 12 desired to be thawed. The user then connects the power cord 52 to a power source such as a portable generator or a wall socket. As the electricity from the power source flows through the power cord 52 through the heating element 50, heat is emitted from the heating element 50 within lower cavity created by the divider member 40 and the outer members 22. The cross members 60 and the divider member 40 prevent the heat of the heating element 50 from damaging the insulation 30 or causing a fire within the present invention. The layer of insulation 30 reduces the amount of heat lost through the upper member 20. The heat emitted from the heating element 50 is retained within the lower cavity and is conducted by the ground 12 surrounded by the outer members 22. The frozen ground 12 eventually is thawed over a period of time thereby allowing the user to dig into the ground 12. After the ground 12 is thawed to the desired temperature, the user then removes the portable ground thawing panel system 10 and begins the desired earth work.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

Index of Elements for Portable Ground Thawing Panel System

ENVIRONMENTAL ELEMENTS

10. Portable Ground Thawing Panel System
11.
12. Ground
13.
14.
15.
16.
17.
18.
19.
20. Upper Member
21.
22. Outer Members
23.
24.
25.
26.
27.
28.
29.
30. Insulation
31.
32.
33.
34.
35.
36.
37.
38.
39.
40. Divider Member
41.
42.
43.
44.
45.
46.
47.
48.
49.
50. Heating Element
51.

-continued

| Index of Elements for Portable Ground Thawing Panel System |
| --- |
| ENVIRONMENTAL ELEMENTS |
| 52. Power Cord |
| 53. |
| 54. |
| 55. |
| 56. |
| 57. |
| 58. |
| 59. |
| 60. Cross Members |
| 61. |
| 62. |
| 63. |
| 64. |
| 65. |
| 66. |
| 67. |
| 68. |
| 69. |
| 70. |
| 71. |
| 72. |
| 73. |
| 74. |
| 75. |
| 76. |
| 77. |
| 78. |
| 79. |

I claim:

1. A portable ground thawing panel system, comprising:

an upper member having an upper surface and a lower surface;

a pair of side outer members and a pair of end outer members extending orthogonally downwardly from an outer perimeter of said lower surface defining an enclosed rectangular area, wherein said side outer members are at least twice as long as said end outer members;

a layer of insulation positioned adjacent said lower surface of said upper member;

a plurality of cross members extending between said side outer members and positioned adjacent said layer of insulation opposite of said upper member, wherein said plurality of cross members are comprised of wood;

a divider member comprised of a heat reflective material attached between said side outer members and said end outer members and attached to said plurality of cross members opposite of said layer of insulation, wherein said divider member and said outer members define a lower heating cavity; and an electrical heating element having a sinusoidal pattern secured to said divider member opposite of said plurality of cross members.

2. The portable ground thawing panel system of claim 1, wherein said divider member is comprised of metal.

* * * * *